US007896472B2

(12) United States Patent
Kondo

(10) Patent No.: US 7,896,472 B2
(45) Date of Patent: Mar. 1, 2011

(54) RECORDING-HEAD DRIVING DEVICE FOR DRIVING RECORDING HEAD

(75) Inventor: Hirofumi Kondo, Tajimi (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 617 days.

(21) Appl. No.: 11/985,425

(22) Filed: Nov. 15, 2007

(65) Prior Publication Data

US 2008/0111859 A1 May 15, 2008

(30) Foreign Application Priority Data

Nov. 15, 2006 (JP) ..... 2006-308503

(51) Int. Cl.
*B41J 2/14* (2006.01)
*B41J 2/05* (2006.01)

(52) U.S. Cl. ..... 347/50; 347/58

(58) Field of Classification Search ..... 347/50, 347/58, 59, 71

See application file for complete search history.

(56) References Cited

U.S. PATENT DOCUMENTS

2006/0044363 A1* 3/2006 Katayama ..... 347/71

FOREIGN PATENT DOCUMENTS

JP 2005193497 7/2005

* cited by examiner

*Primary Examiner* — Stephen Meier

*Assistant Examiner* — Geoffrey Mruk

(74) *Attorney, Agent, or Firm* — Frommer Lawrence & Haug LLP

(57) ABSTRACT

A recording-head driving device for driving a recording head including a plurality of actuator sections each provided for recording on a recording medium, the recording-head driving device including: a wiring board elongated in a longitudinal direction to be connected, at a connected portion near to one of longitudinally opposite ends thereof, to the plurality of actuator sections of the recording head; two drive-circuit units mounted on respective portions of the wiring board such that the connected portion of the wiring board is interposed between the mount portions, in the longitudinal direction, and wherein the wiring board includes: (a) a plurality of wires a part of which connects one of the two drive-circuit units and a part of the plurality of actuator sections, and the rest of which connects the other of the two drive-circuit units and the rest of the plurality of actuator sections; and (b) a plurality of input terminals electrically connected to the two drive-circuit units and provided on the other of the longitudinally opposite ends of the wiring board.

7 Claims, 6 Drawing Sheets

RECORDING-HEAD DRIVING DEVICE FOR DRIVING RECORDING HEAD

CROSS REFERENCE TO RELATED APPLICATION

The present application claims priority from Japanese Patent Application No. 2006-308503, which was filed on Nov. 15, 2006, the disclosure of which is herein incorporated by reference in its entirety.

BACKGROUND OF THE INVENTION

1. Field of the Invention

The present invention relates in to a recording-head driving device for driving a recording head.

2. Discussion of Related Art

In a conventionally known inkjet-type recording apparatus, there has been provided a recording head including a plurality of actuator sections each provided for performing a recording operation on a recording medium. As an example of the inkjet-type recording apparatus, there has been known an apparatus, as disclosed in, for example, a Patent Document 1 (JP-A-2005-193497, in particular, paragraph 0047, 0048 and FIG. 4), which includes a wiring board for supplying a drive signal to each of the plurality of actuator sections. In the disclosed apparatus, one drive-circuit unit (i.e., drive IC) is mounted on the wiring board.

In recent years, there has been increased a demand that the recording head is provided with a large number of the actuator sections. Such a demand causes increase in size of the drive-circuit unit that has wires for connecting the actuator sections and the drive-circuit unit, and also increase in density of wires (or reduction on pitch of the wires). Due to required limitations with respect to the density (or reduction) of the wires and characteristic of the drive-circuit unit, there has been proposed a recording apparatus, as disclosed in the above-identified Patent Document 1, in which two recording heads are provided to be connected to respective two wiring boards such that two drive-circuit units are disposed on the respective two wiring boards.

SUMMARY OF THE INVENTION

In the above-described recording apparatus disclosed in the Patent Document 1 in which the two wiring boards are respectively routed from the respective two recording heads in respective opposite directions, a large space is required for disposing the wiring boards, thereby increasing a size of the recording apparatus. Further, it is cumbersome to connect the wiring boards to a body-side control device. If the two recording heads are provided by a single piece unit with the two drive-circuit units which are disposed on a single wiring board that extends from the single piece unit, an amount of heat generated in each of o drive-circuit units are increased so that operations of the actuator sections could be negatively affected by the increased amount of the generated heat.

The present invention has been developed in view of the background discussed above. It is therefore an object of the present invention to provide a recording-head driving device in which two drive-circuit units are provided in one wiring board so that the number of wires connected to each of the drive-circuit units can be decreased, which arrangements effective to reduce negative influence on operation of each actuator section and to facilitate routing of the wiring board.

To solve the above-described problem, the present invention provides a recording-head driving device for driving a recording head which includes a plurality of actuator sections each provided for performing a recording operation on a recording medium. Further, the recording-head driving device includes: a wiring board which is elongated in a longitudinal direction and which is to be connected, at a connected portion near to one of longitudinally opposite ends thereof, to the plurality of actuator sections of the recording head; two drive-circuit units mounted on respective mount portions of the wiring board such that the connected portion of the wiring board at which the wiring board is connected to the plurality of actuator sections is interposed between the mount portions, in the longitudinal direction. More specifically, the wiring board includes: (a) a plurality of wires a part of which connects one of the two drive-circuit units and a part of the plurality of actuator sections, for supplying a drive signal from the one of the two drive-circuit units to the part of the plurality of actuator sections, and the rest of which connects the other of the two drive-circuit units and the rest of the plurality of actuator sections, for supplying a drive signal from the other of the two drive-circuit units to the rest of the plurality of actuator sections; and (b) a plurality of input terminals which are electrically connected to the two drive-circuit units and are provided on the other of the longitudinally opposite ends of the wiring board.

In this recording-head driving device according to the present invention, the two drive-circuit units are provided, whereby the number of the plurality of wires connected to each of the two drive-circuit units can be decreased, a load imposed on each of the two drive-circuit units can be reduced and a layout of the plurality of wires can be simplified. Further, although each of the two drive-circuit units is a source of heat generation, an influence of the heat generation is not increased even if the two drive-circuit units are provided because the two drive-circuit units are away or distant from each other, with the plurality of actuator sections being interposed therebetween. Further, since the two drive-circuit units are disposed such that an area where the plurality of actuator sections are arranged is interposed between the two drive-circuit units in the direction in which the wiring board is elongated (i.e., in a longitudinal direction of the wiring board), the heat is conducted to this area from both sides of the wiring board in the longitudinal direction thereof. Therefore, a variation of temperature distribution can be reduced. Accordingly, a variation of temperature in the plurality of actuator sections due to the heat generation of the drive-circuit units can be decreased. Further, as described above, since two drive-circuit units are mounted on one wiring board, the wiring board can be routed in only one direction, thereby facilitating the routing of the wiring board in the recording apparatus.

BRIEF DESCRIPTION OF THE DRAWINGS

The above and optional objects, features, and advantages of the present invention will be better understood by reading the following detailed description of preferred embodiments of the invention when considered in conjunction with the accompanying drawings, in which.

DETAILED DESCRIPTION OF THE PREFERRED EMBODIMENTS

Hereinafter, there will be described a preferred embodiment of the present invention by reference to the drawings. It is noted that, in this embodiment, there is adopted an inkjet recording head for color recording.

Figure 1:
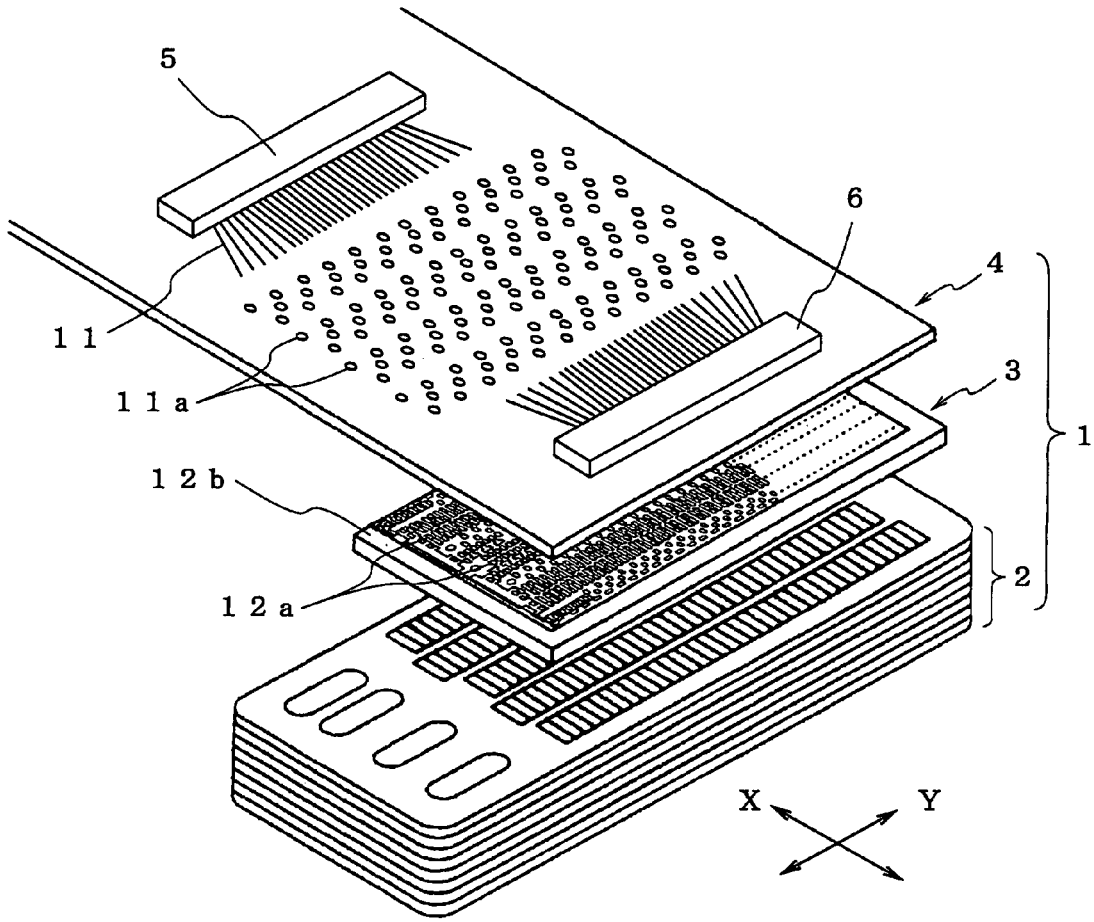
FIG. 1 is a perspective view explaining a relationship among an ink-channel unit, an actuator unit and a flexible wiring board in an ink-jet recording apparatus using a recording-head driving device as an embodiment of the present invention.

FIG. 1 is a perspective view showing a situation in which a flexible wiring board is superposed on and bonded to an upper surface of the recording head, according to the present invention.

As shown in FIG. 1, a recording head 1 includes an ink-channel unit 2 and an actuator unit 3 which are superposed on the ink-channel unit 2. The ink-channel unit 2 includes a plurality of nozzles each opening in a lower surface of the ink-channel unit 2 and a plurality of ink channels respectively corresponding the plurality of nozzles. The actuator unit 3 includes a plurality of actuator sections (not shown) each corresponds to one of the ink channels. As generally known, a piezoelectric element or a heater for boiling an ink can be adopted as each of the actuator sections. Further, on an upper surface of the actuator unit 3, there are provided a plurality of individual electrodes 12*a* for selectively applying an electric voltage to the respective actuator sections and a common electrode 12*b* commonly connected to all of the actuator sections. The recording head 1 is mounted on a carriage that is reciprocated in a direction X (i.e., in a main-scanning direction) perpendicular to a direction Y (i.e., a sub-scanning direction) in which a recording sheet (i.e., a recording medium) is carried. The recording head 1 performs a recording operation on the recording sheet by ejecting the ink via the plurality of nozzles, owing to the actuator sections each being driven.

On the upper surface of the actuator unit 3, there is provided a flexible wiring board 4 for supplying a drive signal to each of the actuator sections. The flexible wiring board 4 has an elongated shape which is elongated in the direction X on the actuator unit 3. On the flexible wiring board 4, there are mounted two drive-circuit units, i.e., a first drive IC 5 and a second drive IC 6 so as to be arranged in parallel to each other in the longitudinal direction of the flexible wiring board 4 with a space left between the first and the second drive ICs 5, 6.

Figure 2:
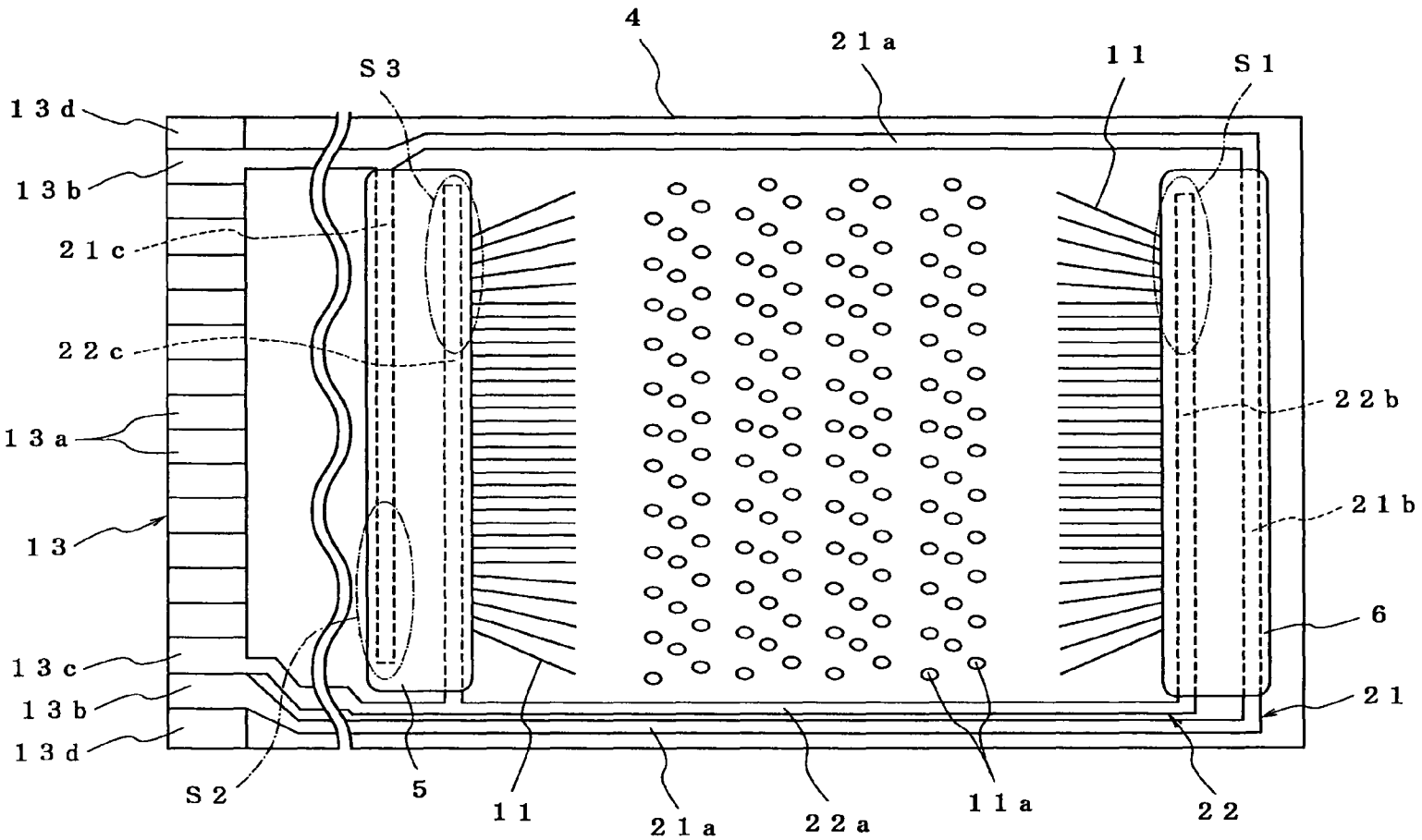
FIG. 2 is a schematic plan view showing the flexible wiring board as one example of the embodiment.
Figure 3:
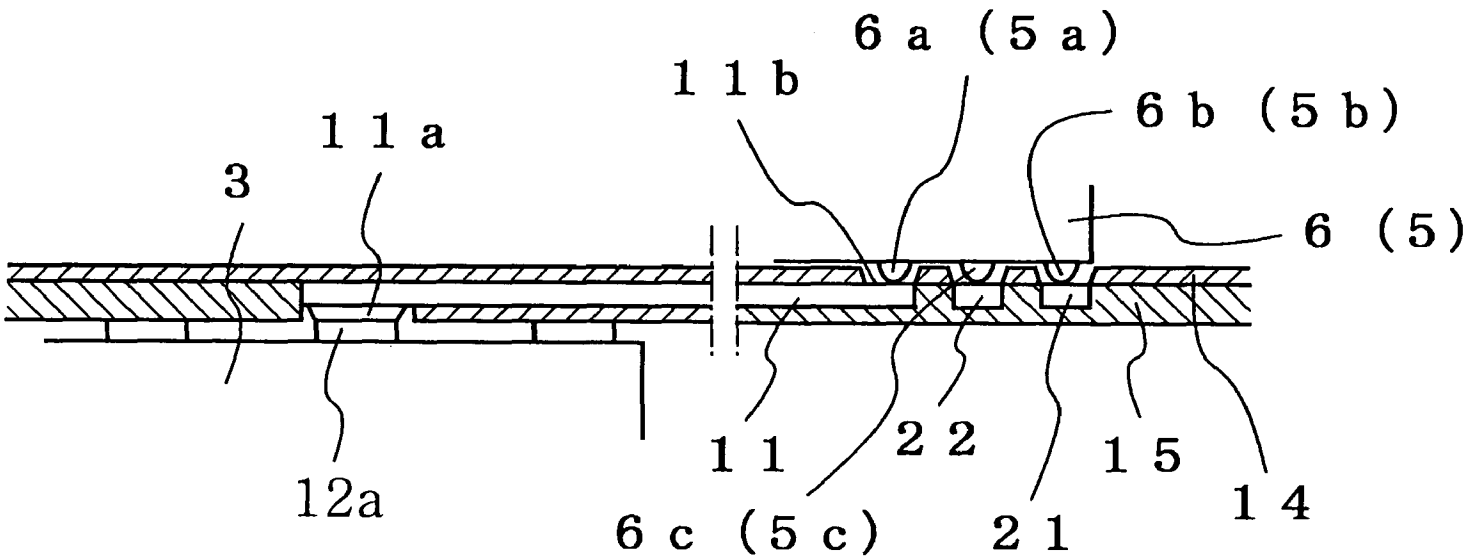
FIG. 3 is a cross-sectional view showing a relationship among a drive IC, wires and an individual electrode in the wiring board.

As shown in FIGS. 2 and 3, in the flexible wiring board 4, there are provided a plurality of wires 11 for supplying the drive signals to the actuator sections. Each of the wires 11 has, in one of opposite end portions thereof, a first terminal portion 11*a* to be connected to a corresponding one of the individual electrodes 12*a* for driving a corresponding one of the actuator sections. That is, the flexible wiring board 4 is connected, at a connected portion thereof, to the actuator sections. In the connected portion, the first terminal portion 11*a* is provided. The first and the second drive ICs 5, 6 are disposed such that an area of the flexible wiring board 4 in which the plurality of first terminal portions 11*a* are arranged is interposed between the first and the second drive ICs 5, 6 in the longitudinal direction of the flexible wiring board 4. Further, each of the wires 11 has, in the other of opposite end portions thereof, a second terminal portion 11*b* to which a corresponding one of output terminals 5*a*, 6*a* respectively provided in the first and the second drive ICs 5, 6 for outputting the drive signals is connected. Connection terminals 5*b*, 5*c* provided in the first drive IC 5 are respectively connected to wires 21, 22 (i.e., a pair of wires). Also, connection terminals 6*b*, 6*c* provided in the second drive IC 6 are respectively connected to the wires 21, 22. A base film 14 and a cover layer 15 constitute the flexible wiring board 4.

The first drive IC 5 supplies drive signals to a part of the first terminal portions 11*a* which are near to the first drive IC 5. The second drive IC 6 supplies drive signals to rest of the first terminal portions 11*a* which are near to the second drive IC 6. That is, the first and the second drive ICs 5, 6 cooperatively take charge of supplying the drive signals to all of the first terminal portions 11*a*.

One of opposite end portions of the flexible wiring board 4 in the longitudinal direction thereof which is nearer to the first drive IC 5 is extended in a direction opposite to the first terminal portions 11*a*. On this extended end portion of the flexible wiring board 4, input terminals 13 are arranged in a widthwise direction of the flexible wiring board 4.

There are provided, for supplying input signals to both of the first and the second drive ICs 5, 6, terminals 13*a* which constitute a part of the input terminals 13 and which are disposed at an intermediate portion (in the above-described extended end portion) of the flexible wiring board 4 in the widthwise direction thereof. Further, there are provided, for supplying the drive voltage for driving the actuator sections to both of the first and the second drive ICs 5, 6, terminals 13*b*, 13*b*, 13*c* which constitute a part of the input terminals 13 and which are disposed at the respective opposite side end portions (in the above-described extended end portion) of the flexible wiring board 4 opposite to each other in the widthwise direction thereof. Further, terminals 13*d*, 13*d* which constitute a part of the input terminals 13 and which are respectively disposed outside of the terminals 13*b*, 13*b* are connected to the common electrode 12*b* provided on the upper surface of the actuator unit 3. These terminals 13*a*, 13*b*, 13*c*, 13*d* are arranged in the widthwise direction of the flexible wiring board 4.

The wire 21, as one of the pair of wires 21, 22 for supplying the drive voltage to the first and the second drive ICs 5, 6, has first portions 21*a*, 21*a* (i.e., a pair of portions) extending along the respective widthwise opposite side end portions of the flexible wiring board 4, such that the first terminal portions 11*a* are interposed between the first portions 21*a*, 21*a*. The first portions 21*a*, 21*a* are connected to each other via a second portion 21*b* extending in a direction perpendicular to a direction in which the first portions 21*a*, 21*a* extend, in a vicinity of the other of the opposite end portions of the flexible wiring board 4 that is opposite to the input terminals 13. That is, the wire 21 is formed into a loop by the first portions 21*a*, 21*a* and the second portion 21*b*. In other words, the first and second portions 21*a*, 21*b* cooperate to provide the wire 21 with substantially U-shape as its entire shape. The second portion 21*b* extends below the second drive IC 6.

A branch wire 21*c* to be connected to the first drive IC 5 is branched from the wire 21 formed into the loop. The branch wire 21*c* has an open or free distal end at which the branch wire 21*c* is not electrically connected to any conductive objects. Inside of the wire 21 formed into the loop, in one of opposite side end portions of the flexible wiring board 4 in the widthwise direction thereof, there is provided the wire 22 as the other of the pair of wires 21, 22. The wire 22 has a wire portion 22*a* extending in parallel with the first portions 21*a* of the wire 21. A first branch wire 22*b* is branched from a distal end of the wire portion 22*a*, in a vicinity of the other of the opposite end portions of the flexible wiring board 4. The first branch wire 22*b* has a distal end that is open or free and extends below the second drive IC 6. Further, in the wire 22, a second branch wire 22*c* is branched from an intermediate portion of the wire portion 22*a*. The second branch wire 22*c* has a distal end that is open or free and extends below the first drive IC 5.

Each of the first and the second drive ICs 5, 6 is mounted on the flexible wiring board 4, such that the connection terminals 5*c*, 6*c* (that are provided in a side of the flexible wiring board 4 to which the drive voltage is supplied) are respectively connected to the first and the second branch wires 22*b*, 22*c* of the wire 22, and such that the connection terminals 5*b*, 6*b* (that are provided in a side of the flexible wiring board 4 which is to be connected to the ground) are respectively connected to the branch wire 21*c* and the second portion 21*b* of the wire 21.

On the flexible wiring board 4, outside the first portions 21*a*, 21*a* of the wire 21, there are respectively provided wires (not shown) for connecting or interconnecting the respective terminals 13*d*, 13*d* and the common electrode 12*b* provided on the upper surface of the actuator unit 3.

Further, on the flexible wiring board 4, there are provided input-signal wires (not shown) for connecting the terminals 13*a* provided in the widthwise intermediate portion of the flexible wiring board 4 and the first and the second terminals 5, 6. The input-signal wires includes first input-signal wires interconnecting the terminals 13*a* and respective input terminals of the first drive IC 5 and second input-signal wires interconnecting the terminals 13*a* and respective input terminals of the second drive IC 6. The first input-signal wires extend almost in straight. The second input-signal wires extend in non-straight rather than in straight. Specifically described, the second input-signal wires passes through a space defined between the wire portion 22*a* and the free distal end of the branch wire 21*c*, a space defined between the branch wire 21*c* and the second branch wire 22*c*, a space defined between one of the first wire portions 21*a* and the free distal end of the second branch wire 22*c*, and a space defined between the one of the first wire portions 21*a* and the first terminal portion 11*a*, so as to reach the input terminals provided in a portion of lower surface of the second drive IC 6 that is located between the branch wire 22*b* an the second portion 21*b*.

The input terminals 13 are electrically connected to a control device provided in a body of the recording apparatus. The control device is configured to generate input signals and drive voltages that are supplied to the input terminals 13.

The input signals inputted to the terminal 13*a* provided in the intermediate portion are serially inputted to the first and the second drive ICs 5, 6. In each of the first and the second drive ICs 5, 6, the input signals are converted into parallel signals corresponding to an arrangement of the first terminal portions 11*a*, then converted into the drive signals having a voltage corresponding to the drive voltage inputted from the wire 22. The converted drive signals are supplied to the respective individual electrodes 12*a* via the respective wires 11, thereby driving the respective actuator sections. The drive circuits provided in each of the first and the second drive ICs 5, 6 for generating respective drive signals to be supplied to the respective actuator sections are independent of each other, such that each of the drive circuits serves for a corresponding one of the actuator sections. The drive voltage is supplied, via the wire 22, to the respective drive circuits which are connected to the ground via the wire 21. The drive signals are outputted from the respective drive circuits via the respective wires 11.

The wire 21 to be connected to the ground is formed in the loop shape, which makes it possible to decrease a resistance difference between opposite end portions and an intermediate portion of the second portion 21*b*. As a result, in a plurality of positions to which the respective drive circuits of the drive IC 6 are connected, it is possible to reduce variation of an electric potential difference between the second portion 21*b* of the wire 21 and the first branch wire 22*b* of the wire 22 for supplying the drive voltage, so that the respective drive circuits of the drive IC 6 can be almost equally operated. The arrangement may be modified such that the drive voltage may be supplied from the wire 21 formed in the loop shape, while the wire 22 is connected to the ground. In this modified arrangement, voltage drop is decreased in the opposite end portions and the intermediate portion of the second portion 21 of the wire 21 from which the drive voltage is supplied, so that the drive circuits of drive IC 6 can be almost equally operated.

The recording head 1 in the above-described embodiment has the plurality of nozzles arranged in rows that respectively correspond to four different color inks. The rows are arranged in parallel to the first and the second drive ICs 5, 6, namely, the respective rows of the first terminal portions 11*a* (shown in FIG. 2) are arranged in parallel to the first and the second drive ICs 5, 6. However, the voltage drop may be occurred due to an increase of the resistance in accordance with an increase of lengths of the first and the second branch wires 22*b*, 22*c*, at the respective distal ends thereof (see S1, S3 shown in FIG. 2). Further, the electric potential difference may be decreased between the distal end of the branch wire 21*c* to be connected to the ground (see S2 shown in FIG. 2) and the second branch wire 22*c* for supplying the drive voltage. In these cases, specific ones of the wires 11 for supplying the drive signals to specific ones of the actuator sections which are used or operated at a relatively low frequency may be connected to a portion of each of the first and the second drive ICs 5, 6 in which the voltage drop is occurred or the electric potential difference is decreased, thereby avoiding a recording failure due to the voltage drop or the decrease of the electric potential difference. For instance, the specific ones of the actuator sections may be provided by those serving for yellow-color ink, cyan-color ink and magenta-color ink and so on which are used at the relatively low frequency as compared to the black ink.

Figure 4:
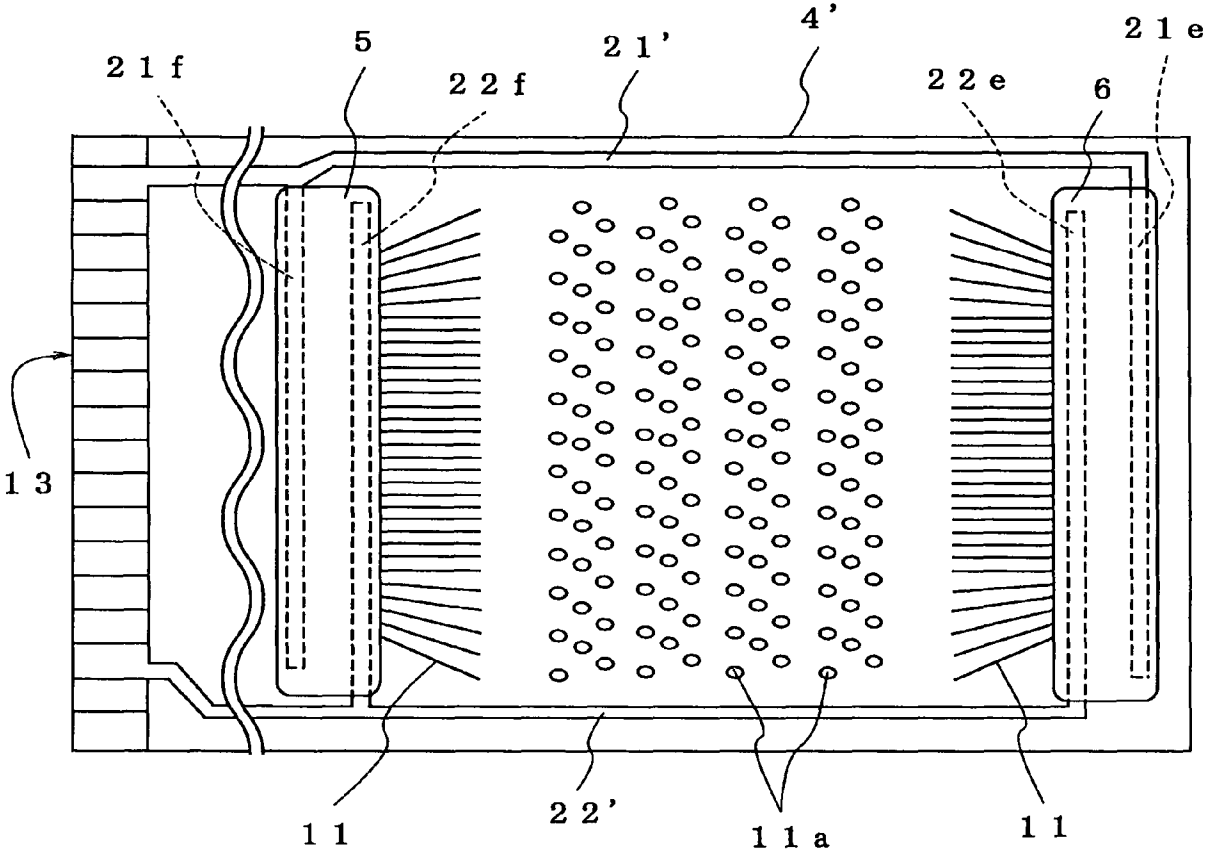
FIG. 4 is a schematic plan view showing a flexible wiring board as a second example of the embodiment.

In the above-described embodiment, the wire 21, as the one of the pair of wires 21, 22 for supplying the drive voltage to the actuator sections, is formed into the loop form in the vicinity of the above-described other of the opposite end portions of the flexible wiring board 4 (that is opposite to the input terminals 13). However, the present embodiment is not limited to details of the above-described example. The embodiment according to the present invention encompasses the following examples:

(i) As shown in FIG. 4, there may be respectively provided, in opposite side end portions of flexible wiring board 4', a pair of wires 21', 22' for supplying the drive voltage (for driving the actuator sections) to both of the first and the second drive ICs 5, 6 (each as the drive circuit units). Further, there may be provided two first branch wires 21*e*, 21*f* to be respectively connected to the second and the first drive ICs 6, 5 and two second branch wires 22*e*, 22*f* to be respectively connected to the second and the first drive ICs 6, 5. The two first branch wires 21*e*, 21*f* are branched from the wire 21' (i.e., one of the pair of wires). Each of the two first branch wires 21*e*, 21*f* has a free distal end. The two second branch wires 22*e*, 22*f* are branched from the wire 22' (i.e., the other of the pair of wires). Each of the two second branch wires 22*e*, 22*f* has a free distal end.

Figure 5:
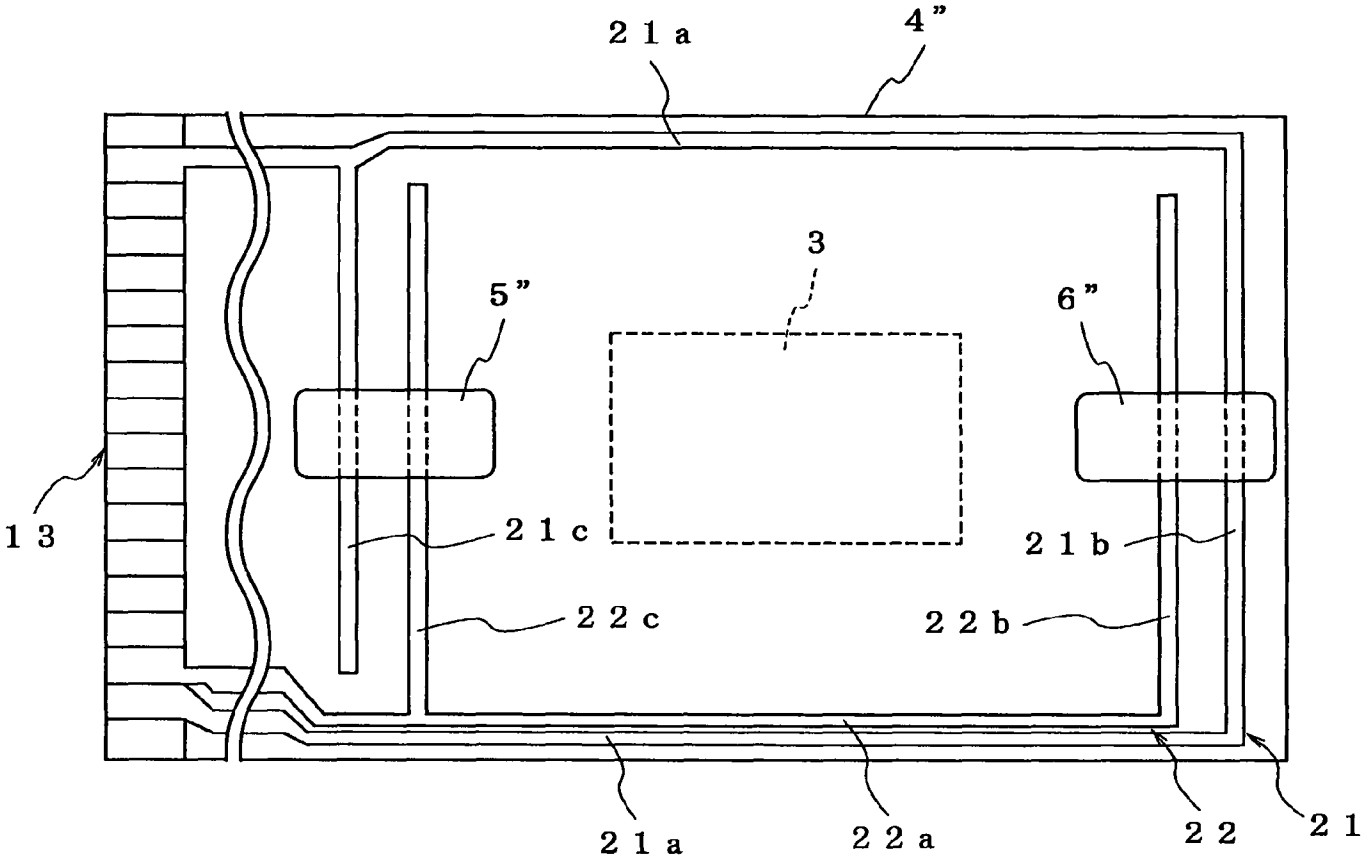
FIG. 5 is a schematic plan view showing a flexible wiring board as a third example of the embodiment.

(ii) The first and second drive ICs 5, 6 do not necessarily have to extend in the direction perpendicular to the longitudinal direction of a flexible wiring board 4 (i.e., the direction Y shown in FIG. 1). For example, as first and second drive ICs 5', 6' provided on a flexible wiring board 4" that is shown in FIG. 5, the first and the second drive ICs 5, 6 may extend in the longitudinal direction of the flexible wiring board 4 (i.e., the direction X shown in FIG. 1).

Figure 6:
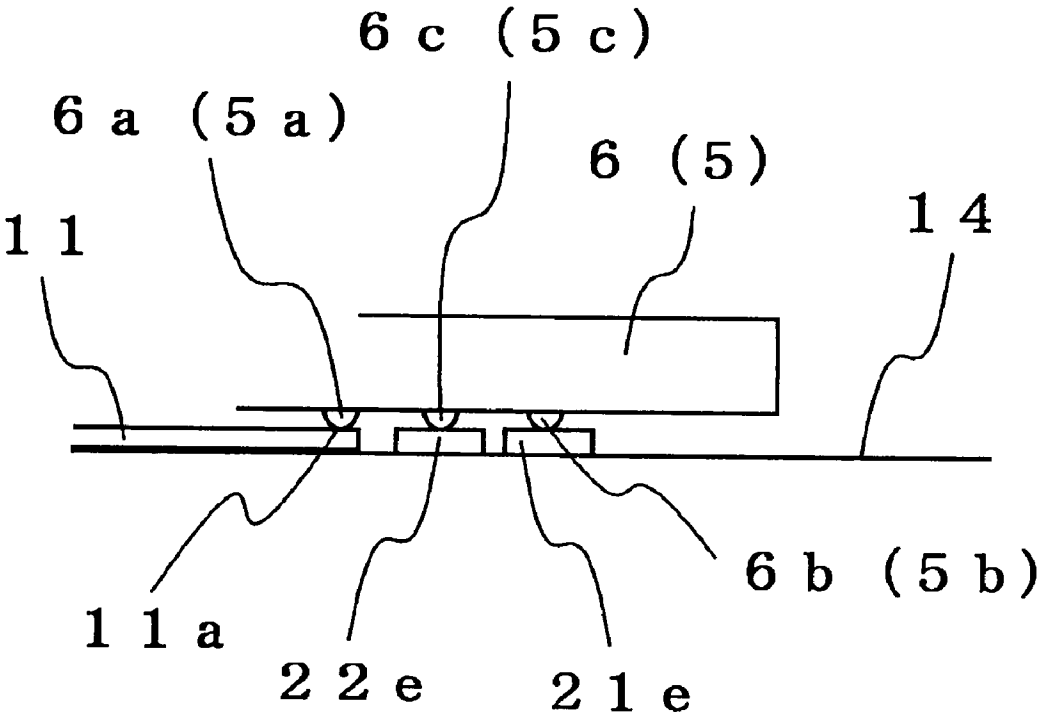
FIG. 6 is a cross-sectional view showing a relationship among a drive IC, wires and a base film in a wiring board as a forth example of the embodiment.

(iii) In the above-described embodiment, the first and the second drive ICs 5, 6 and the wires 11 are respectively provided in opposite sides of the base film 14 which is interposed therebetween. However, as shown in FIG. 6, the first and the second drive ICs 5, 6 and the wires 11 may be provided in the same side as one of the opposite sides of the base film 14.

The present invention can be adopted to various recording-head driving devices such as a thermal head, other than the ink-jet recording head. It is to be understood that the invention is not limited to the details of the illustrated embodiments, but may be embodied with various changes and modifications, which may occur to those skilled in the art, without departing from the spirit and scope of the invention defined in the attached claims.

What is claimed is:

1. A recording-head driving device for driving a recording head including a plurality of actuator sections each provided for performing a recording operation on a recording medium, the recording-head driving device comprising:

a wiring board which is elongated in a longitudinal direction and which is to be connected, at a connected portion near to one of longitudinally opposite ends thereof, to the plurality of actuator sections of the recording head; and two drive-circuit units mounted on respective mount portions of the wiring board such that the connected portion of the wiring board at which the wiring board is connected to the plurality of actuator sections is interposed between the mount portions, in the longitudinal direction;

wherein the wiring board includes:

(a) a plurality of wires a part of which connects one of the two drive-circuit units and a part of the plurality of actuator sections, for supplying a drive signal from the one of the two drive-circuit units to the part of the plurality of actuator sections, and the rest of which connects the other of the two drive-circuit units and the rest of the plurality of actuator sections, for supplying a drive signal from the other of the two drive-circuit units to the rest of the plurality of actuator sections; and (b) a plurality of input terminals which are electrically connected to the two drive-circuit units and are provided on the other of the longitudinally opposite ends of the wiring board;

wherein the wiring board further includes a pair of wires provided for applying, to the two drive-circuit units, a drive voltage for driving the plurality of actuator sections;

wherein one of the pair of wires includes:

(a) a pair of first portions each of which is connected to a corresponding one of the plurality of input terminals and which extend along respective opposite side end portions of the wiring board opposite to each other in the widthwise direction thereof; and (b) a second portion which connects, in a vicinity of the one of the longitudinally opposite ends of wiring board, the pair of first portions such that the one of the pair of wires is formed into a loop; and wherein one of the two drive-circuit units is distant from the plurality of input terminals by a distance that is larger than a distance between the other of the two drive-circuit units and the plurality of input terminals, the one of the two drive-circuit units being connected to the one of the pair of wires at the second portion thereof that connects the pair of first portions thereof.

2. The recording-head driving device according to claim 1;

wherein the wiring board includes a branch wire which is connected to the other of the two drive-circuit units, and the branch wire is branched from one of the pair of first portions of the one of the pair of wires and has a free distal end.

3. The recording-head driving device according to claim 2;

wherein specific ones of the plurality of wires are connected to a portion of the other of the two drive-circuit units, which portion being located in a vicinity of the free distal end of the branch wire, and wherein the specific ones of the plurality of wires are respectively connected, for supplying the drive signal, to specific ones of the plurality of actuator sections which are used at low frequency.

4. The recording-head driving device according to claim 1;

wherein the other of the pair of wires extends along one of the opposite side end portions of the wiring board, and is disposed inside one of the pair of first portions of the one of the pair of wires, and wherein the wiring board includes two branch wires which are respectively connected to the two drive-circuit units, each of which is branched from the other of the pair of wires and each of which has a free distal end.

5. The recording-head driving device according to claim 4;

wherein specific ones of the plurality of wires are connected to a portion of each of the two drive-circuit units, which portion being located in a vicinity of the free distal end of a corresponding one of the two branch wires, and wherein the specific ones of the plurality of wires are respectively connected, for supplying the drive signal, to specific ones of the plurality of actuator sections which are used at low frequency.

6. A recording-head driving device for driving a recording head including a plurality of actuator sections each provided for performing a recording operation on a recording medium, the recording-head driving device comprising:

a wiring board which is elongated in a longitudinal direction and which is to be connected, at a connected portion near to one of longitudinally opposite ends thereof, to the plurality of actuator sections of the recording head; and two drive-circuit units mounted on respective mount portions of the wiring board such that the connected portion of the wiring board at which the wiring board is connected to the plurality of actuator sections is interposed between the mount portions, in the longitudinal direction;

wherein the wiring board includes:

(a) a plurality of wires a part of which connects one of the two drive-circuit units and a part of the plurality of actuator sections, for supplying a drive signal from the one of the two drive-circuit units to the part of the plurality of actuator sections, and the rest of which connects the other of the two drive-circuit units and the rest of the plurality of actuator sections, for supplying a drive signal from the other of the two drive-circuit units to the rest of the plurality of actuator sections; and (b) a plurality of input terminals which are electrically connected to the two drive-circuit units and are provided on the other of the longitudinally opposite ends of the wiring board; and wherein the wiring board includes:

a pair of wires provided for applying, to the two drive-circuit units, a drive voltage for driving the plurality of actuator sections, each of which is connected to a corresponding one of the plurality of input terminals and which extend along respective opposite side end portions of the wiring board opposite to each other in the widthwise direction thereof;

two first branch wires which are respectively connected to the two drive-circuit units, each of which is branched from one of the pair of wires and each of which has a free distal end; and two second branch wires which are respectively connected to the two drive-circuit units, each of which is branched from the other of the pair of wires and each of which has a free distal end.

7. The recording-head driving device according to claim 6;

wherein specific ones of the plurality of wires are respectively connected to portions of each of the two drive-circuit units, which portions being respectively located in a vicinity of the free distal end of a corresponding one of the two first branch wires and in a vicinity of the free distal end of a corresponding one of the two second branch wires, and wherein the specific ones of the plurality of wires are respectively connected, for supplying the drive signal, to specific ones of the plurality of actuator sections which are used at low frequency.

* * * * *